US010759200B2

(12) United States Patent
Ando

(10) Patent No.: US 10,759,200 B2
(45) Date of Patent: Sep. 1, 2020

(54) THERMAL PRINTER MODULE AND THERMAL PRINTER

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/363,217

(22) Filed: Mar. 25, 2019

(65) Prior Publication Data

US 2019/0299665 A1 Oct. 3, 2019

(30) Foreign Application Priority Data

Mar. 27, 2018 (JP) ..... 2018-059223

(51) Int. Cl.
*B41J 11/04* (2006.01)
*B41J 2/325* (2006.01)
(Continued)

(52) U.S. Cl.
CPC ..... *B41J 11/04* (2013.01); *B41J 2/32* (2013.01); *B41J 2/325* (2013.01); *B41J 11/13* (2013.01); *B41J 11/24* (2013.01); *B41J 2202/31* (2013.01)

(58) Field of Classification Search
CPC ... B41J 25/304; B41J 2/32; B41J 2/325; B41J 2202/31; B41J 25/308; B41J 25/3082;
(Continued)

(56) References Cited

U.S. PATENT DOCUMENTS

2007/0286659 A1 12/2007 Yamada
2016/0059588 A1 3/2016 Aizawa

FOREIGN PATENT DOCUMENTS

EP 1900531 A1 3/2008
JP 2007-331112 A 12/2007
JP 2016-120618 A 7/2016

OTHER PUBLICATIONS

Extended European Search Report in Europe Application No. 19165612.3, dated Aug. 9, 2019, 8 pages.

*Primary Examiner* — Kristal Feggins
(74) *Attorney, Agent, or Firm* — Brinks Gilson & Lione

(57) ABSTRACT

A thermal printer module includes: a housing; a cover; a platen roller provided to the cover; a support frame having a groove configured to receive a shaft of the platen roller; a lock arm configured to hold down, by a platen roller engagement portion, the shaft of the platen roller inserted into the groove; a biasing member configured to apply a biasing force to the lock arm; and a printing head. Wherein, when viewed in a direction extending along an axis of the shaft, the platen roller engagement portion and a tangential line of a track obtained when the axis of the shaft moves along with an opening operation of the cover form an intersection angleθAB in a closing direction of the lock arm, and the intersection angle θAB satisfies a relation of 90°≤θAB≤110°. Wherein the platen roller engagement portion and a tangential line of a track obtained when a contact point between the shaft and the platen roller engagement portion pivots in an unlocking direction of the lock arm form an intersection angle θBC in the closing direction of the lock arm, and the intersection angle θBC satisfies a relation of 0°≤θBC≤10°.

4 Claims, 10 Drawing Sheets

(51) Int. Cl.

| | |
|---|---|
| ***B41J 2/32*** | (2006.01) |
| ***B41J 11/24*** | (2006.01) |
| ***B41J 11/13*** | (2006.01) |

(58) Field of Classification Search

CPC ..... B41J 25/3084; B41J 25/3086; B41J 25/3088; B41J 25/312; B41J 25/316; B41J 11/04; B41J 11/13; B41J 11/24

See application file for complete search history.

THERMAL PRINTER MODULE AND THERMAL PRINTER

RELATED APPLICATIONS

This application claims priority under 35 U.S.C. § 119 to Japanese Patent Application No. 2018-059223 filed on Mar. 27, 2018, the entire content of which are hereby incorporated by reference.

BACKGROUND OF THE INVENTION

1. Field of the Invention

The present invention relates to a thermal printer module and a thermal printer.

2. Description of the Related Art

Hitherto, thermal printers are configured to perform printing by heating a printing surface of a recording sheet with heating elements of a thermal head to develop a color on the printing surface while feeding the recording sheet through rotation of a platen roller under a state in which the recording sheet is nipped between the platen roller and the thermal head. In those thermal printers, the platen roller is removable to facilitate work of replacing the recording sheet.

A thermal printer includes a main body frame, a thermal head, platen bearings, bearing insertion grooves formed in the main body frame, a lock lever (lock arm) movable from a locking position where the platen bearings are locked so as not to detach from the bearing insertion grooves to an unlocking position where the platen bearings are detachable from the bearing insertion grooves, and a lever biasing member configured to bias the lock lever constantly toward the locking position. The platen bearings are pressed against inner peripheral end surfaces of the bearing insertion grooves by the lock lever located at the locking position, to thereby fix the positions of the platen bearings with respect to the main body frame.

In a thermal printer module of the above-mentioned thermal printer, however, there is a case in which an external force caused by drop impact or the like may be applied to the main body frame or the lock arm to distort the respective components, resulting in decrease in holding force of the lock arm for the platen roller. In such a case, there is a risk of such trouble that the platen roller may drop off from the main body frame. This type of thermal printer module is generally mounted in a housing having an openable and closable cover, but the strength of the housing cannot be set extremely high in consideration of weight and cost of the thermal printer. Thus, when the thermal printer drops off, a force caused by distortion or twist is generated in the housing due to the drop impact, and the force is applied to the main body frame or the lock arm so that the above-mentioned trouble may occur. Further, when the platen roller drops off, the cover is opened so that the device may be damaged or the recording sheet may drop off, resulting in inconvenience to the user of the printer.

In view of the above-mentioned matters, in this type of thermal printer, it has been required that the platen roller can be stably held.

SUMMARY OF THE INVENTION

According to one embodiment of the present invention, there is provided a thermal printer module, including: a housing including a roll sheet receiving portion; a cover, which is mounted to the housing so as to be pivotable, and is configured to open and close the roll sheet receiving portion; a platen roller provided to the cover so as to be freely rotatable; a support frame, which is provided in the housing, and has a groove configured to receive a shaft of the platen roller to be inserted into the groove when the cover is closed; a lock arm, which is provided to the support frame so as to be pivotable, and is configured to hold down, by a platen roller engagement portion, the shaft of the platen roller inserted into the groove; a biasing member configured to apply a biasing force to the lock arm in a direction of causing the lock arm to pivot so as to maintain holding of the shaft by the platen roller engagement portion; and a printing head provided at a position opposed to the platen roller having the shaft held in the groove, wherein, when viewed in a direction extending along an axis of the shaft, the platen roller engagement portion and a tangential line of a track obtained when the axis of the shaft held in the groove moves along with an opening operation of the cover form an intersection angle $\theta AB$ in a closing direction of the lock arm, and the intersection angle $\theta AB$ satisfies a relation of $90° \leq \theta AB \leq 110°$, and wherein, when viewed in the direction extending along the axis of the shaft, the platen roller engagement portion and a tangential line of a track obtained when a contact point between the shaft held in the groove and the platen roller engagement portion pivots in an unlocking direction of the lock arm form an intersection angle $\theta BC$ in the closing direction of the lock arm, and the intersection angle $\theta BC$ satisfies a relation of $0° \leq \theta BC \leq 10°$.

In the above-mentioned printer according to the one embodiment of the thermal printer module, wherein when viewed in the direction extending along the axis of the shaft, the platen roller engagement portion and the tangential line of the track obtained when the contact point between the shaft held in the groove and the platen roller engagement portion pivots in the unlocking direction of the lock arm are parallel to each other.

In the above-mentioned printer according to the one embodiment of the thermal printer module, wherein when viewed in the direction extending along the axis of the shaft, the platen roller engagement portion and the tangential line of the track obtained when the axis of the shaft held in the groove moves along with the opening operation of the cover are orthogonal to each other.

According to one embodiment of the present invention, there is provided a thermal printer, including the above-mentioned thermal printer module.

DETAILED DESCRIPTION OF THE PREFERRED EMBODIMENTS

Figure 1:
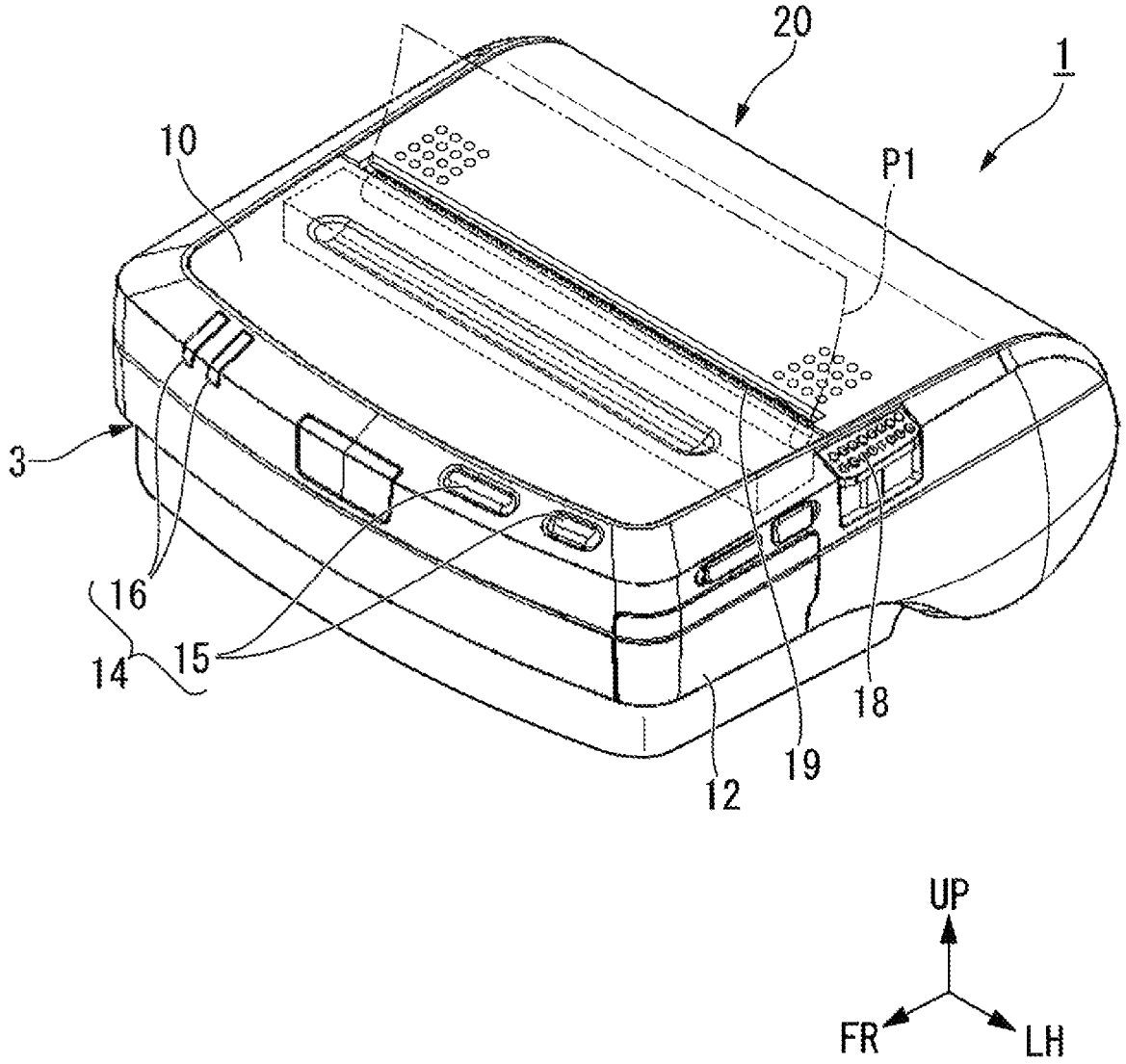
FIG. 1 is a perspective view of a thermal printer according to one embodiment of the present invention, for illustrating a state in which a paper cover is closed.
Figure 2:
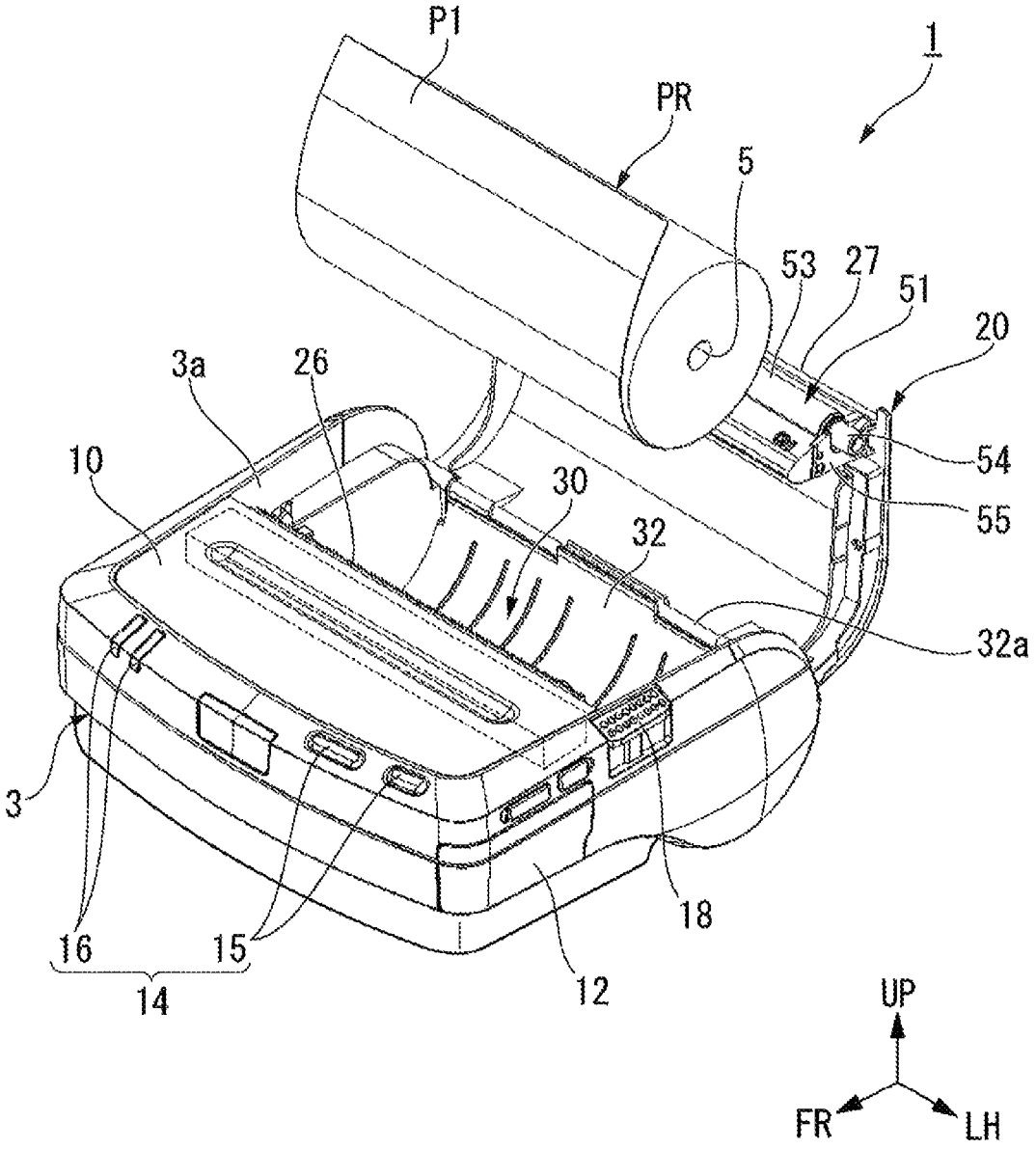
FIG. 2 is a perspective view of the thermal printer, for illustrating a state in which the paper cover is opened.

Now, a thermal printer including a thermal printer module according to one embodiment of the present invention is described with reference to the accompanying drawings. FIG. 1 is a perspective view for illustrating a thermal printer when a paper cover is closed. FIG. 2 is a perspective view for illustrating the thermal printer when the paper cover is opened. In the drawings, the arrow UP is defined as an upper side, the arrow FR is defined as a front side, and the arrow LH is defined as a left side.

As illustrated in FIG. 1, a thermal printer 1 is configured to be capable of performing printing on a recording sheet P1. The recording sheet P1 is a heat-sensitive sheet that develops color through application of heat, and is suitably used for printing, for example, a variety of labels, receipts, and tickets. As illustrated in FIG. 2, the recording sheet P1 is set in the thermal printer 1 under a state of a roll sheet PR having a hollow hole 5, which is obtained by winding the recording sheet P1. Printing is performed on a part drawn out from the roll sheet PR.

The thermal printer 1 includes a casing 3 (housing) having an opening portion 3*a*, and a paper cover 20 supported on the casing 3 in a pivotable manner and configured to open and close the opening portion 3*a* of the casing 3. Further, the thermal printer 1 has a thermal printer module 30 mounted therein.

The casing 3 has a box shape, and is made of plastics such as polycarbonate or a metal material. An upper wall 10 is formed on a front part of the casing 3. Ribs (not shown) or the like are formed on an inner surface of the casing 3 to enhance the mechanical strength of the casing 3. On the upper wall 10 of the casing 3, operation portions 14 configured to perform a variety of operations for the thermal printer 1 are arranged. As the operation portions 14, a variety of function switches 15 such as a power switch and a FEED switch are arranged, and a variety of indicator lamps 16 are arranged, such as a POWER indicator lamp provided adjacent to the function switches 15 and configured to indicate ON/OFF information of the power switch, and an ERROR indicator lamp 16 configured to indicate an error of the thermal printer 1. Further, an open button 18 configured to perform opening and closing operations for the paper cover 20 is provided between the upper wall 10 and a side wall 12. Moreover, a first cutting blade 26 configured to cut the recording sheet P1 is formed at a rear end edge of the front wall 10 of the casing 3.

The paper cover 20 is made of plastic such as polycarbonate. A rear end of the paper cover 20 is supported by a hinge portion 32*a* so that the paper cover 20 is rotatable with respect to a main body frame 31 (support frame, see FIG. 3) of the thermal printer module 30. Further, a front end of the paper cover 20 is configured to be capable of being locked to the main body frame 31 by a platen roller 51 mounted to the front end of the paper cover 20. Through pressing of the open button 18 of the casing 3, locking between the paper cover 20 and the casing 3, in which the main body frame 31 is mounted, is cancelled so that the paper cover 20 can be changed from the closed position (see FIG. 1) to the open position (see FIG. 2). Further, as illustrated in FIG. 1, when the paper cover 20 is positioned at the closed position, a gap is defined along the width direction of the recording sheet P1 between a front edge of the paper cover 20 and the rear end edge of the front wall 10 of the casing 3. The gap forms a delivery slot 19 through which the recording sheet P1 subjected to printing is delivered. Moreover, a second cutting blade 27 (see FIG. 2) configured to cut the recording sheet P1 is formed at the front edge of the paper cover 20. The recording sheet P1 delivered through the delivery slot 19 is cut by being pulled down in a contact state with the first cutting blade 26 or the second cutting blade 27.

Figure 3:
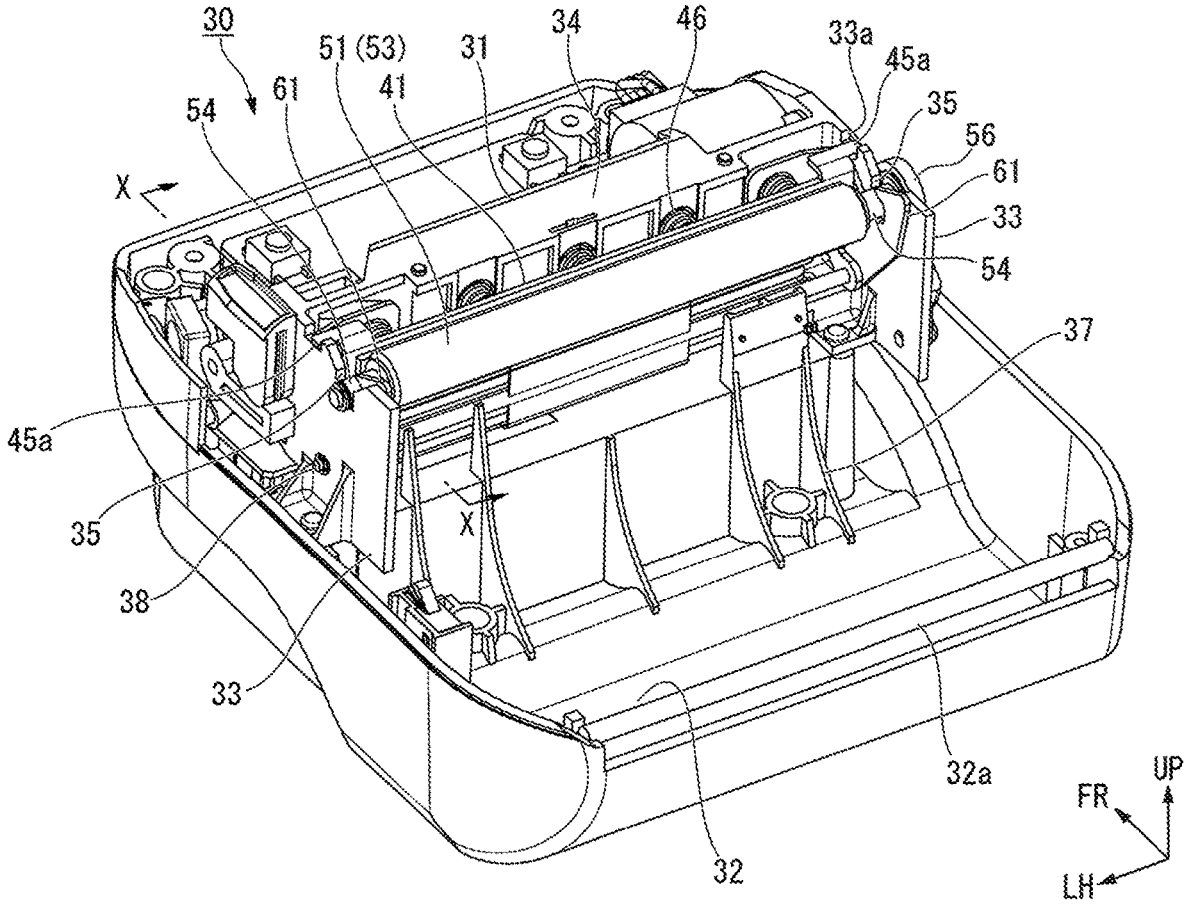
FIG. 3 is a perspective view for illustrating a thermal printer module of the thermal printer.
Figure 4:
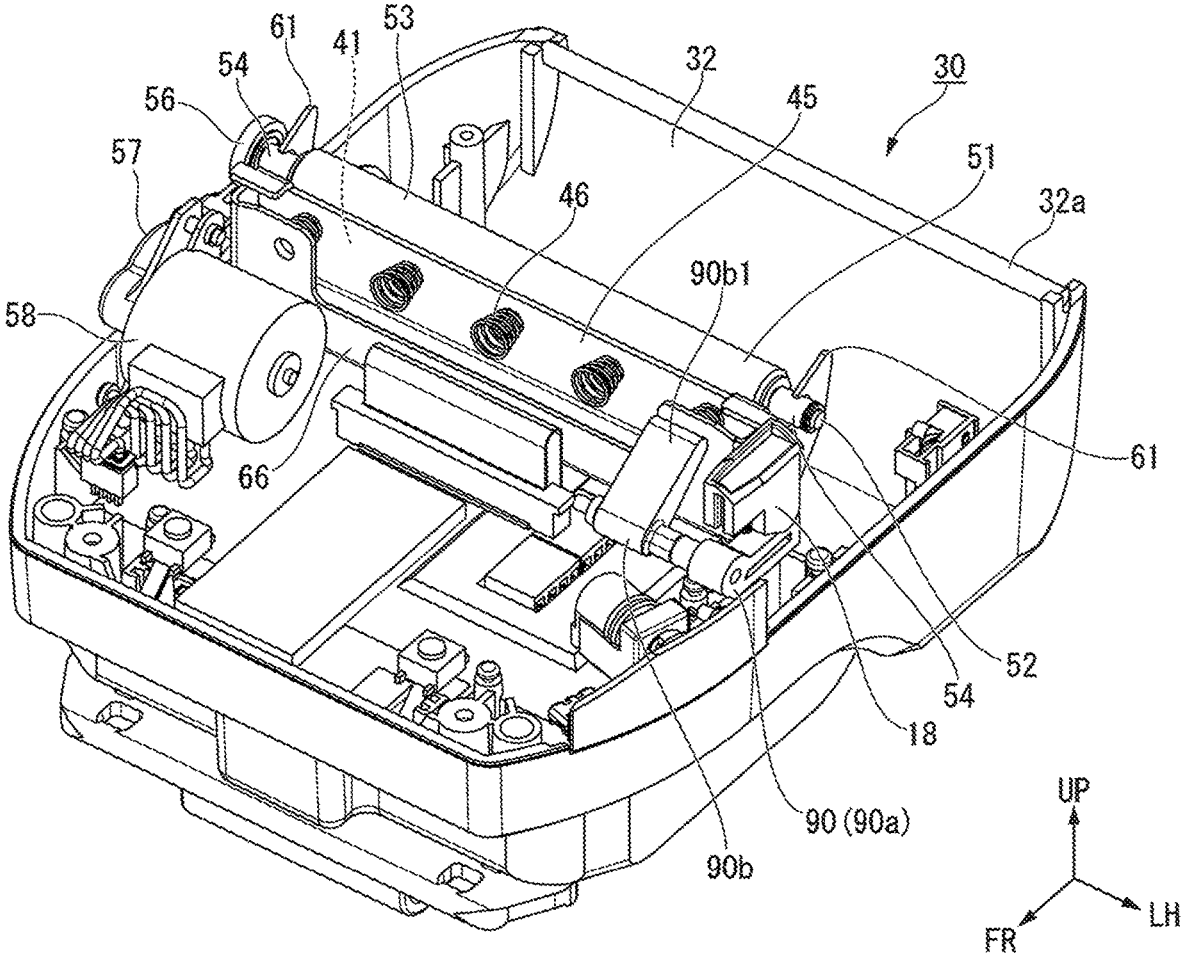
FIG. 4 is a perspective view of the thermal printer module when viewed in a direction different from that in FIG. 3.
Figure 5:
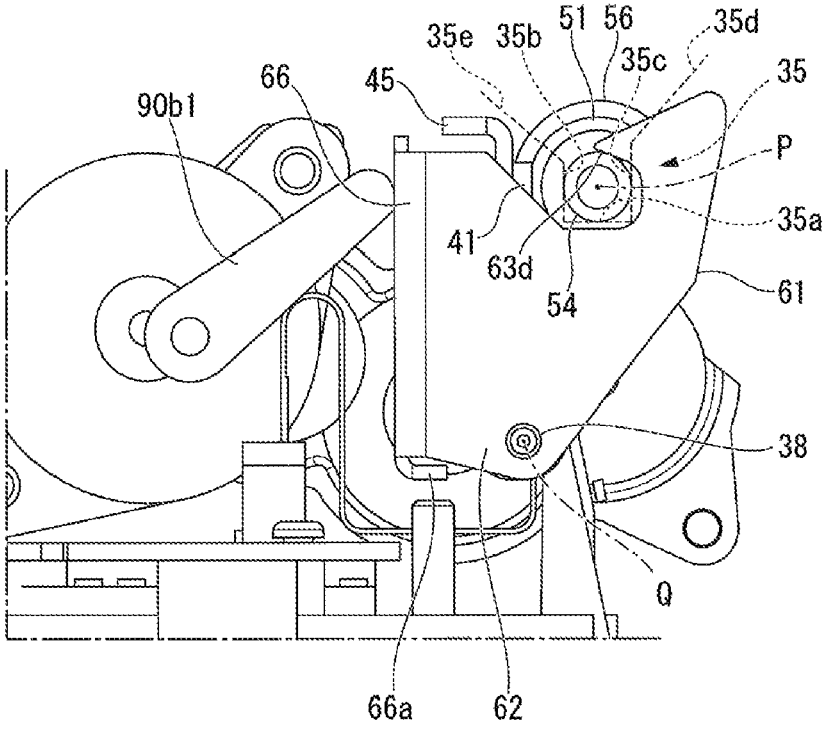
FIG. 5 is an explanatory view for illustrating an operation of a lock arm of the thermal printer module, and is a partial enlarged view of the thermal printer module when viewed in a direction indicated by the line X-X of FIG. 3.

FIG. 3 is a perspective view of the thermal printer module 30. Further, FIG. 4 is a perspective view of the thermal printer module 30 when viewed in a direction different from that in FIG. 3. For description, some components are removed in illustration of FIG. 4. Further, FIG. 5 is an explanatory view for illustrating an operation of a lock arm 61 of the thermal printer module 30, and is a partial enlarged view of the thermal printer module 30 when viewed in a direction indicated by the line X-X of FIG. 3. As illustrated in FIG. 3, the thermal printer module 30 includes the main body frame 31, a thermal head 41 (printing head), the platen roller 51, and the lock arm 61.

The main body frame 31 includes a sheet receiving portion 32 (roll receiving portion) formed at a bottom part thereof to extend in a right-and-left direction, a pair of side wall portions 33 formed upright from both sides of the sheet receiving portion 32 in the right-and-left direction toward the upper side, and a front wall portion 34 formed upright from a front side of the sheet receiving portion 32 toward the upper side. The sheet receiving portion 32 is herein described as being included in the thermal printer module 30 (main body frame 31), but the sheet receiving portion 32 may be provided separately from the thermal printer module 30. The sheet receiving portion 32 holds the roll sheet PR. The sheet receiving portion 32 is a member having an arc shape in cross section, and a rear end of the sheet receiving portion 32 extends to the rear end side of the paper cover 20 (see FIG. 2), whereas a front end of the sheet receiving portion 32 extends to a lower side of the platen roller 51. The hinge portion 32*a* configured to support the paper cover 20 in a pivotable manner is formed at a rear end edge of the sheet receiving portion 32. Further, a plurality of guide members 37 are arranged above the front end of the sheet receiving portion 32 so as to be in conformity with a curved surface of the sheet receiving portion 32. With the guide member 37, the recording sheet P1 is smoothly introduced toward the thermal head 41.

As illustrated in FIG. 3 and FIG. 5, roller insertion grooves 35 cut downward are formed in upper edges of the respective side wall portions 33. Relative positions of the lock arm 61 and the roller insertion grooves 35 differ from each other along an axis of the platen roller 51, and hence the roller insertion groove 35 is indicated by the broken line in FIG. 5. As illustrated in FIG. 5, the platen roller 51 is inserted into the roller insertion grooves 35 in a state of being removable from the roller insertion grooves 35 along an up-and-down direction. Each roller insertion groove 35 is defined by a groove bottom surface 35*a* extending along a front-and-rear direction, a groove front surface 35*b* extending from a front end of the groove bottom surface 35*a* toward the upper side, a groove rear surface 35*c* extending from a rear end of the groove bottom surface 35*a* toward the upper side, a groove inclined surface 35*d* extending from an upper end of the groove rear surface 35*c* obliquely toward an upper rear side, and a groove inclined surface 35*e* extending from an upper end of the groove front surface 35*b* obliquely toward an upper front side.

The length of the groove bottom surface 35*a* in the front-and-rear direction is slightly larger than the outer diameter of each bearing 54 of the platen roller 51. Each of the groove front surface 35*b* and the groove rear surface 35*c* is orthogonal to the groove bottom surface 35*a*. The length of the groove front surface 35*b* in the up-and-down direction is smaller than the outer diameter of the bearing 54. The length of the groove rear surface 35*c* in the up-and-down direction is larger than the outer diameter of the bearing 54. The groove front surface 35*b* and the groove rear surface 35*c* are parallel to each other, whereas the groove inclined surfaces 35*d* and 35*e* are formed so as to be gradually away from each other as extending toward the upper side. The roller insertion grooves 35 are formed at the same position when viewed in the right-and-left direction, and the platen roller 51 is inserted into the roller insertion grooves 35 in a state of extending along the right-and-left direction and being removable from the roller insertion grooves 35 along the up-and-down direction. Due to the groove inclined surfaces 35*d* and 35*e*, the opening width of each roller insertion groove 35 is increased as extending toward the upper side. Thus, the bearings 54 of the platen roller 51 are smoothly insertable into the roller insertion grooves 35.

The thermal head 41 illustrated in FIG. 5 is configured to perform printing on the recording sheet P1, and is formed into a rectangular shape when viewed in the front-and-rear direction. The thermal head 41 is arranged on an inner side of the upper wall 10 (see FIG. 2) of the casing 3 so as to be exposed into the opening portion 3*a*, and is arranged under a state in which a longitudinal direction of the thermal head 41 matches with the width direction of the recording sheet P1. On a head surface of the thermal head 41, a large number of heating elements (not shown) are arrayed in line and in parallel to the right-and-left direction. The head surface is opposed to a printing surface of the recording sheet P1, and the recording sheet P1 may be nipped between the head surface and an outer peripheral surface of the platen roller 51. The heating elements of the thermal head 41 are each controlled to generate heat based on a signal from a control unit (not shown). Through the control of heat generation of the heating elements, the thermal head 41 prints various kinds of letters and figures on the printing surface of the recording sheet P1.

As illustrated in FIG. 4 and FIG. 5, the thermal head 41 is bonded and fixed onto the head support member 45 supported on the main body frame 31. The head support member 45 is a plate-like member having its longitudinal direction defined as the right-and-left direction. The head support member 45 is arranged between the pair of side wall portions 33, and the thermal head 41 is bonded onto a rear surface of the head support member 45. The head support member 45 is arranged behind the front wall portion 34 of the main body frame 31, and a lower end portion of the head support member 45 is supported on a shaft 38 in a pivotable manner. The shaft 38 is arranged so that a center axis of the shaft 38 is defined along the right-and-left direction, and both end portions of the shaft 38 are fixed to the pair of side wall portions 33, respectively. As illustrated in FIG. 4, a plurality of (in this embodiment, five) elastic members 46 (biasing members) are interposed between the head support member 45 and the front wall portion 34 along the right-and-left direction. The elastic members 46 are coil springs configured to bias the head support member 45 and the front wall portion 34 in directions away from each other. The elastic members 46 are configured to press the head support member 45 constantly rearward.

Stoppers 45*a* configured to regulate a pivot range of the head support member 45 are formed at upper end portions of the head support member 45. Each stopper 45*a* extends outward in a right-and-left direction of the head support member 45, and is formed so as to face an inside of a recessed portion 33*a* formed in an upper part of the side wall portion 33 of the main body frame 31. The stopper 45*a* is configured to move inside the recessed portion 33*a* along with the pivot of the head support member 45, and may be brought into contact with both end surfaces of the recessed portion 33*a*. Through the contact of the stopper 45*a* with the end surfaces of the recessed portion 33*a*, the pivot amount of the head support member 45 is regulated.

The platen roller 51 is arranged so as to be opposed to the thermal head 41, and is rotated about an axis extending along the right-and-left direction under a state in which the recording sheet P1 is nipped between the platen roller 51 and the thermal head 41, to thereby convey the recording sheet P1. As illustrated in FIG. 4, the platen roller 51 includes a roller shaft 52, a roller main body 53 externally mounted on the roller shaft 52, and a pair of the bearings 54 mounted at both ends of the roller shaft 52. The roller shaft 52 is formed slightly longer than the separation distance between the pair of side wall portions 33 of the main body frame 31. The roller main body 53 is made of, for example, rubber, and is arranged along an axial direction of the roller shaft 52 uniformly over the entire region excluding portions corresponding to both the ends of the roller shaft 52.

As illustrated in FIG. 2, the platen roller 51 is mounted in a freely pivotable manner at the front end edge of the paper cover 20 through intermediation of a platen frame 55, and is removable from the main body frame 31 along with the opening and closing operation of the paper cover 20. As illustrated in FIG. 1 and FIG. 3, when the paper cover 20 is closed, the pair of bearings 54, which are mounted at both ends of the platen roller 51, are inserted into the roller insertion grooves 35 of the main body frame 31, respectively. Thus, the platen roller 51 is held so as to be rotatable about a center axis P (see FIG. 5) relative to the main body frame 31 and removable from the main body frame 31. The platen roller 51 is arranged so that the roller main body 53 is brought into contact with the thermal head 41 under the state in which the platen roller 51 is inserted into the roller insertion grooves 35 and the recording sheet P1 drawn out from the roll sheet PR is nipped between the platen roller 51 and the thermal head 41.

As illustrated in FIG. 4, a driven gear 56 is fixed to one axial end of the platen roller 51. The driven gear 56 meshes with a gear transmission mechanism 57 mounted on the main body frame 31 when the platen roller 51 is held on the pair of side wall portions 33. The gear transmission mechanism 57 is connected to driving means 58 such as a motor to transmit a rotational driving force from the driving means 58 to the driven gear 56. Thus, the platen roller 51 is rotated in a state of being held on the pair of side wall portions 33, thereby being capable of conveying the recording sheet P1.

Figure 6:
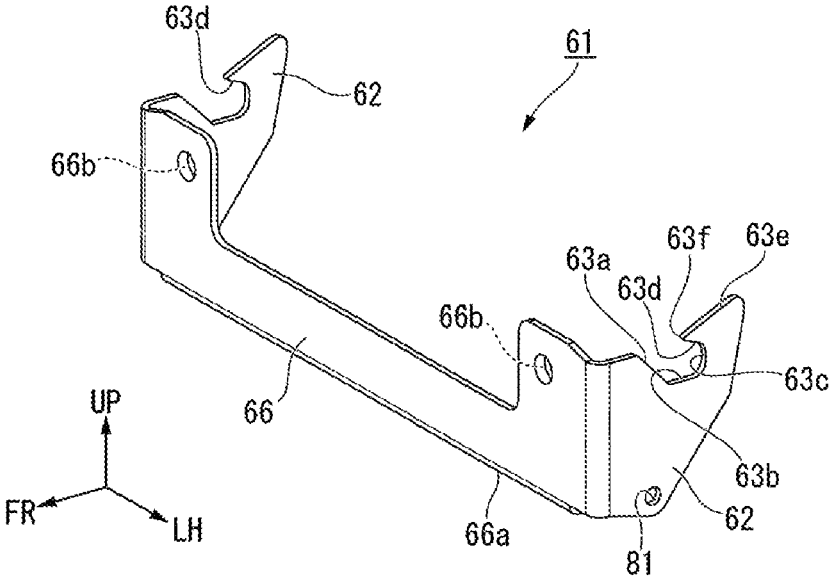
FIG. 6 is a perspective view for illustrating the lock arm.
Figure 7:
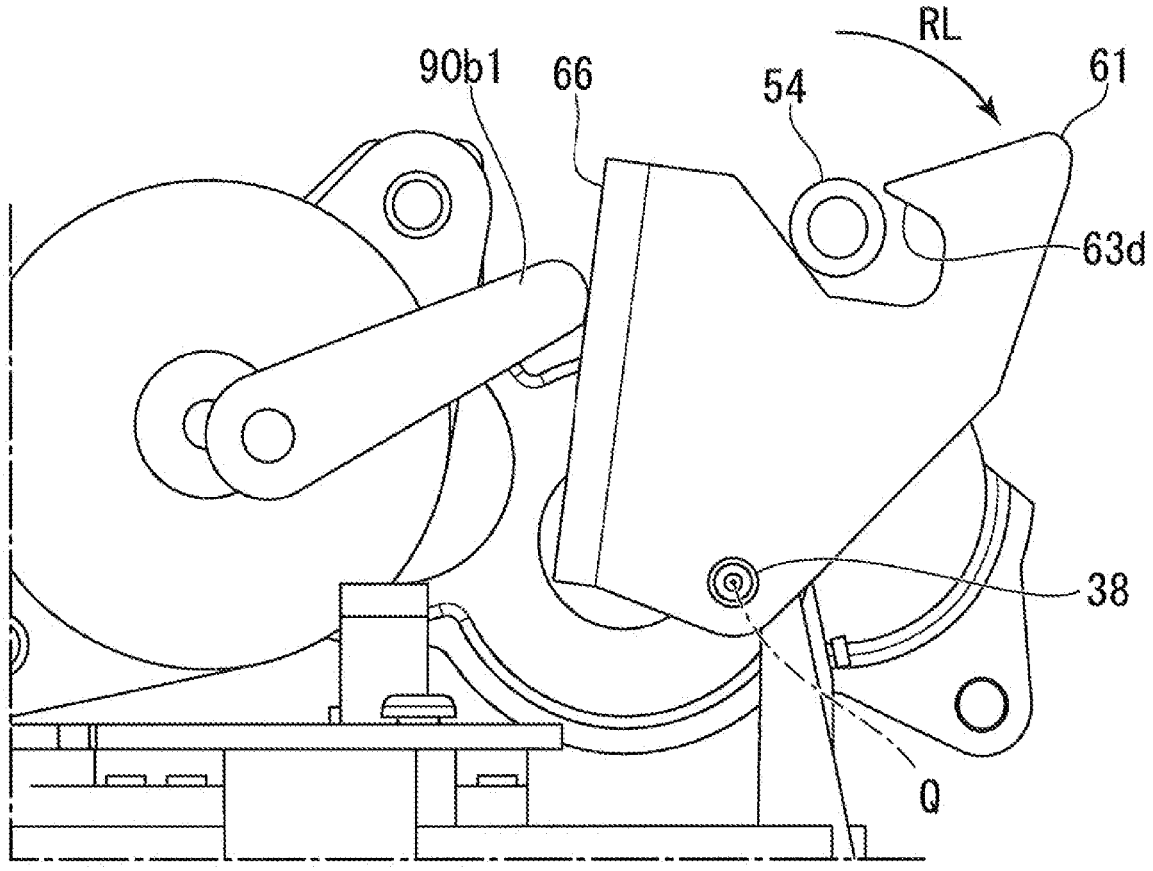
FIG. 7 is an explanatory view for illustrating the operation of the lock arm, and is a partial enlarged view for illustrating an unlocked state.

FIG. 6 is a perspective view of the lock arm 61. FIG. 7 is an explanatory view for illustration the operation of the lock arm 61, and is a partial enlarged view for illustrating a state in which a locked state illustrated in FIG. 5 is cancelled. As illustrated in FIG. 5 and FIG. 6, the lock arm 61 is supported so as to be pivotable about a pivot axis (center axis Q) extending along the right-and-left direction, and is configured to hold the platen roller 51 inserted into the roller insertion grooves 35. The lock arm 61 includes a pair of side plate portions 62 extending along the pair of side wall portions 33 of the main body frame 31, respectively, and a rear plate portion 66 connecting the pair of side plate portions 62. The pair of side plate portions 62 are formed into the same shape, and hence only one of the side plate portions 62 is described below. Unless otherwise noted, the following description of the structure of the lock arm 61 is directed to a state in which the lock arm 61 holds the platen roller 51 inserted into the roller insertion grooves 35 (the state illustrated in FIG. 5, and hereinafter referred to as "holding state").

As illustrated in FIG. 5 and FIG. 6, the side plate portion 62 is a flat plate-like portion, and a through hole 81 is formed in a lower part of the side plate portion 62. The through hole 81 is formed into a circular shape having an axis perpendicular to a plate surface of the side plate portion 62, and the shaft 38 is coaxially fitted into the through hole 81. Accordingly, the shaft 38 supports the lock arm 61 as well as the head support member 45. The shaft 38 is arranged so that the center axis Q is defined along the right-and-left direction, and both axial end portions of the shaft 38 are fixed to the pair of side wall portions 33, respectively. Through the through holes 81 and the shaft 38, the lock arm 61 pivots along an arc path about the center axis Q of the shaft 38 in the front-and-rear direction.

As illustrated in FIG. 6, at an upper edge of the side plate portion 62, there are formed an inclined surface 63*a*, a horizontal surface 63*b*, an arc surface 63*c*, an inclined surface 63*d*, an inclined surface 63*e*. The inclined surface 63*a* extends linearly and obliquely toward a lower rear side. The horizontal surface 63*b* extends from a lower end of the inclined surface 63*a* toward the rear side. The arc surface 63*c* extends in a substantially arc shape from a rear end of the horizontal surface 63*b* toward the upper side. The inclined surface 63*d* extends from an upper end of the arc surface 63*c* linearly and obliquely toward the upper front side. The inclined surface 63*e* extends from an upper end of the inclined surface 63*d* toward the rear side. A distal end portion 63*f* formed between the inclined surface 63*d* and the inclined surface 63*e* has a small arc shape when viewed in the right-and-left direction. The arc surface 63*c* is formed into an arc shape conforming to the outer peripheral surface of the bearing 54 of the platen roller 51 when viewed in the right-and-left direction, and has a curvature radius slightly larger than a radius of the bearing 54. Further, when the side plate portion 62 is viewed from the front side, the inclined surface 63*d* functions as a platen roller engagement portion configured to press the bearing 54 of the platen roller 51 from the upper side of the bearing 54.

As illustrated in FIG. 5, the lock arm 61, which includes the side plate portion 62 having the above-mentioned shape, holds down the bearing 54 in the roller insertion groove 35 through abutment of the inclined surface 63*d* (platen roller engagement portion) against a peripheral surface of the bearing 54. On this occasion, the distal end portion 63*f* (front end of the inclined surface 63*d*) is located in a region close to the thermal head 41 side (front side) with respect to an imaginary plane including the center axis P of the platen roller 51 and the center axis Q of the shaft 38. Further, the distal end portion 63*f* is formed so that a shortest distance between the distal end portion 63*f* and the horizontal surface 63*b* is larger than the outer diameter of the bearing 54.

As illustrated in FIG. 6, the rear plate portion 66 is a substantially U-shaped flat plate-like portion having its longitudinal direction defined as the right-and-left direction, and is arranged between the pair of side plate portions 62. The rear plate portion 66 is formed integrally with the pair of side plate portions 62 to connect front edges of the pair of side plate portions 62. Further, as illustrated in FIG. 5, a reinforcement rib 66*a* is formed at a lower edge of the rear plate portion 66 to extend toward the rear side. As illustrated in FIG. 6, the reinforcement rib 66*a* is formed over a substantially entire length of the rear plate portion 66, and is configured to prevent torsion and flexure of the rear plate portion 66.

Further, two projecting portions 66*b* are formed on both upper portions of the rear plate portion 66. The elastic members 46 are externally fitted to the projecting portions 66*b* so that the elastic members 46 are positioned. As illustrated in FIG. 4, the pair of elastic members 46 positioned by the projecting portions 66*b* are interposed between the rear plate portion 66 and the head support member 45, and thus bias the lock arm 61 so as to cause the lock arm 61 to pivot about the center axis Q toward the front side. As a result, as illustrated in FIG. 5, the lock arm 61 can continuously lock the bearing 54 of the platen roller 51 in the roller insertion groove 35.

As illustrated in FIG. 4, the thermal printer module 30 includes a lever 90. The lever 90 is mounted on the left side wall portion 33 in a freely pivotable manner. One end portion 90*a* of the lever 90 is arranged on an outer side of the side wall portion 33, whereas another end portion 90*b* of the lever 90 located opposite to the one end portion 90*a* across a pivot axis of the lever 90 is arranged on an inner side of the side wall portion 33. The another end portion 90*b* includes an arm portion 90*b*1 that pivots together with the one end portion 90*a*. A proximal end side of the arm portion 90*b*1 is rotated coaxially with the one end portion 90*a*, and a distal end side of the arm portion 90*b*1 is held in abutment against a front surface of the rear plate portion 66 in a freely slide-contact manner. A lower end of the open button 18 is held in abutment against an upper surface of a rear end portion of the one end portion 90*a*. With the configuration described above, when a user depresses the open button 18, the one end portion 90*a* and the another end portion 90*b* of the lever 90 pivot. Then, as illustrated in FIG. 7, the distal end of the arm portion 90*b*1 pushes the lock arm 61 at the rear plate portion 66, to thereby cause the lock arm 61 to pivot about the center axis Q in a direction indicated by the arrow RL. As a result, the inclined surface 63*d* is disengaged from the bearing 54, and hence the platen roller 51 is disengaged from the roller insertion groove 35, thereby being capable of opening the paper cover 20.

From the viewpoint of ease of operation, it is preferred that unlocking of the bearing 54 by the lock arm 61 be smoothly performed when a user depresses the open button 18. However, when only the ease of unlocking is taken into consideration, in a case in which an external force caused by dropping or the like is applied to the thermal printer 1, there is a fear in that unlocking is unintentionally performed so that the paper cover 20 is opened. In order to prevent such unintentional unlocking, the thermal printer 1 according to this embodiment adopts a configuration described below.

Figure 8:
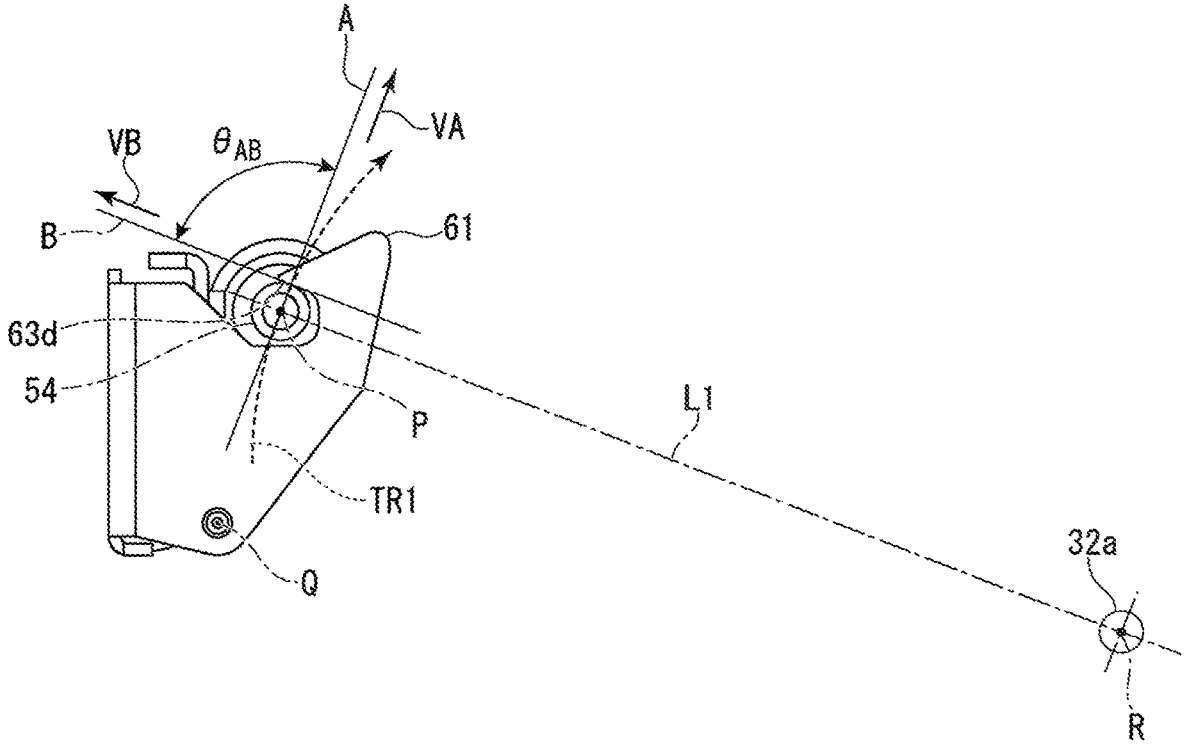
FIG. 8 is a view for illustrating a state in which a bearing of a platen roller is inserted into a roller insertion groove and locked by the lock arm, and illustrating a desirable relative positional relationship between a platen roller engagement portion of the lock arm and a tangential line of pivot of the platen roller.

FIG. 8 is a view for illustrating a state in which the bearing 54 is inserted into the roller insertion groove 35 and locked by the lock arm 61, and illustrating a desirable positional relationship between a straight line B extending along the inclined surface 63*d* of the lock arm 61 and a pivoting-direction tangential line A of the platen roller 51. A center axis R illustrated in FIG. 8 corresponds to a pivot center line of the hinge portion 32*a*, and is parallel to the center axes P and Q. Further, the broken line denoted by the reference symbol TR1 shows a pivot track of the center axis P pivoting about the center axis R. As illustrated in FIG. 8, when viewed in the right-and-left direction extending along the center axis P, a relation of $90° \leq \theta_{AB} \leq 110°$ is satisfied in a case in which $\theta_{AB}$ represents an intersection angle in a closing direction of the lock arm 61. The intersection angle $\theta_{AB}$ is formed between the straight line B extending along the inclined surface 63*d* and the tangential line A of the pivot track TR1 obtained when the center axis P of the bearing 54 held in the roller insertion groove 35 moves along with the opening operation of the paper cover 20.

In this case, the tangential line A corresponds to a tangential line at a position of the center axis P when the center axis P of the bearing 54 is fixed at one point on the pivot track TR1 by holding down an upper surface of the bearing 54 inserted into the roller insertion groove 35 by the inclined surface 63*d* of the lock arm 61. Accordingly, the tangential line A is orthogonal to a straight line L1 that passes the center axes P and R. Further, the straight line B corresponds to a straight line extending along the inclined surface 63*d* when the inclined surface 63*d* is viewed in the right-and-left direction. In FIG. 8, for clear illustration, the straight line B includes an extension line of the inclined surface 63*d*. The above-mentioned intersection angle $\theta_{AB}$ in the closing direction of the lock arm 61 refers to an angle formed between a vector VA at the position of the center axis P at the time when the center axis P starts pivoting along the tangential line A in an unlocking direction, and a vector VB having a direction of separating away from the center axis R along the straight line B.

Figure 9:
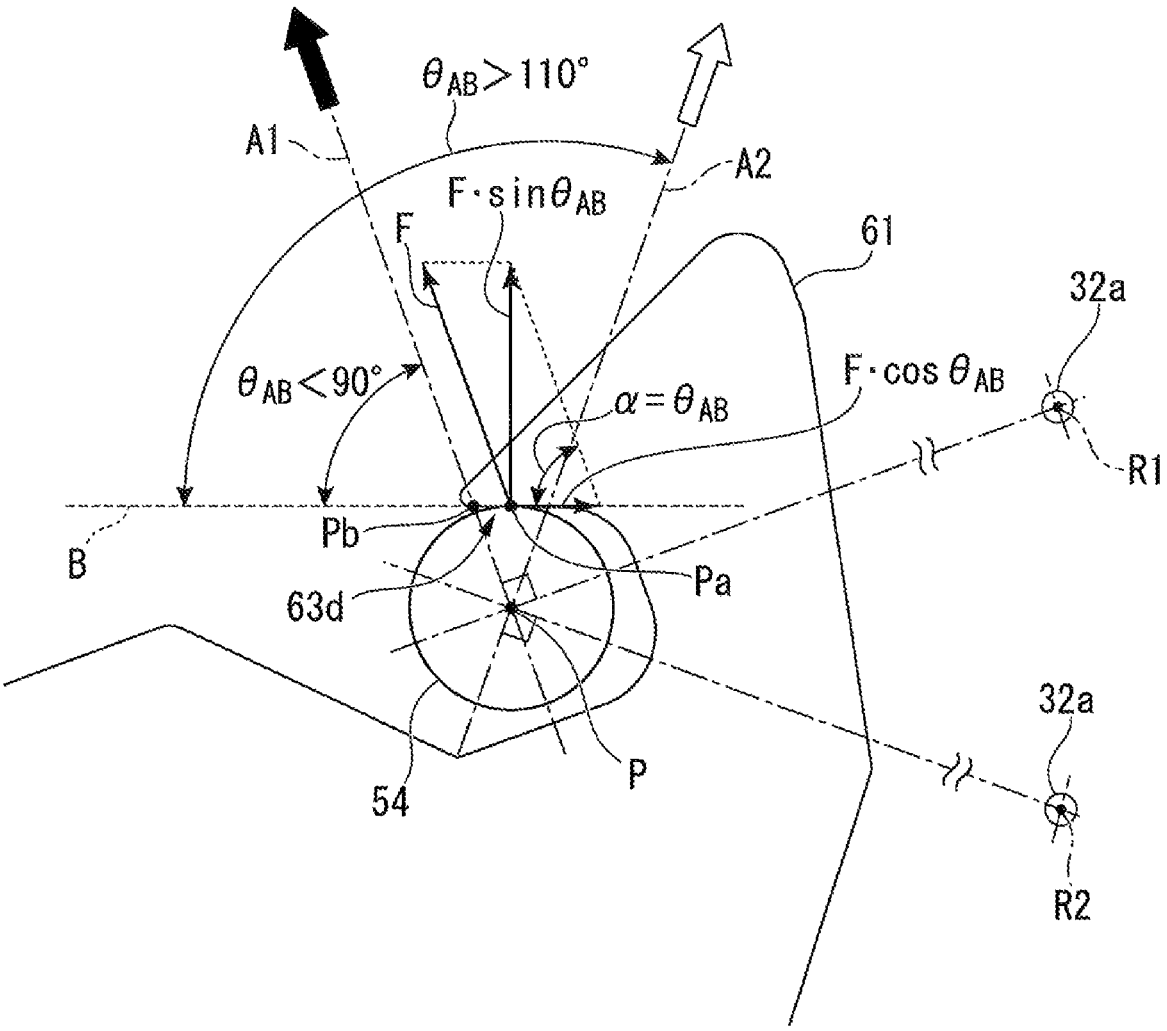
FIG. 9 is a partial enlarged view for illustrating a state in which the bearing of the platen roller is inserted into the roller insertion groove and locked by the lock arm, and illustrating an undesirable relative positional relationship between a straight line B extending along the platen roller engagement portion of the lock arm and pivoting-direction tangential lines Al and A2 of a center axis P of the platen roller.

The intersection angle $\theta_{AB}$ is now described with reference to FIG. 9. FIG. 9 is a partial enlarged view for illustrating a state in which the bearing 54 of the platen roller 51 is inserted into the roller insertion groove 35 (not shown) and locked by the lock arm 61, and illustrating an undesirable relative positional relationship between the straight line B extending along the inclined surface 63*d* of the lock arm 61 and pivoting-direction tangential lines A1 and A2 of the center axis P of the platen roller 51. That is, FIG. 9 is a partial enlarged view for illustrating a case in which the center axis R of the hinge portion 32*a* is located at an undesirable position (R1, R2) with respect to the inclined surface 63*d* of the lock arm 61. The reference symbol R1 represents the center axis of the hinge portion 32*a* when the intersection angle $\theta_{AB}$ is smaller than 90°, whereas the reference symbol R2 represents the center axis of the hinge portion 32*a* when the intersection angle $\theta_{AB}$ is larger than 110°.

First, when the intersection angle $\theta_{AB}$ is smaller than 90°, the inclined surface 63*d* is brought into abutment against the peripheral surface of the bearing 54 at a contact point Pa. The contact point Pa is closer to the center axis R1 than the pivoting-direction tangential line A1. For example, when the external force received by the casing 3 causes a force F in a direction of disengaging the bearing 54 from the roller insertion groove 35, the force F parallel to the pivoting-direction tangential line A1 is applied to the inclined surface 63*d* at the contact point Pa. The force F generates a force component $F \cdot \sin \theta_{AB}$, which is applied to the inclined surface 63*d* in the vertical direction, and a force component $F \cdot \cos \theta_{AB}$, which is applied along the inclined surface 63*d* and pushes away the lock arm 61 in the unlocking direction. An angle denoted by the reference symbol $\alpha$ in FIG. 9 is equal to the intersection angle $\theta_{AB}$. Even when a frictional force between the bearing 54 and the inclined surface 63*d* is increased by intensifying the elastic members 46 configured to bias the lock arm 61 in the closing direction, it is difficult to reliably maintain the locked state against the force component $F \cdot \cos \theta_{AB}$. Therefore, in a case in which the intersection angle $\theta_{AB}$ is smaller than 90°, when the external force is applied to the thermal printer 1, there is a fear in that the locking of the bearing 54 by the lock arm 61 is cancelled so that the paper cover 20 is opened.

Meanwhile, in a case in which the intersection angle $\theta_{AB}$ is equal to 90° as illustrated in FIG. 8, even when the above-mentioned external force F is applied, the force component $F \cdot \cos \theta_{AB}$ satisfies a relation of $F \cdot \cos 90° = 0$. Therefore, the force component of pushing away the lock arm 61 along the inclined surface 63*d* in the unlocking direction becomes zero. Thus, even when there is no pressurization by the elastic members 46 at the time of application of the external force to the thermal printer 1, the locked state of the bearing 54 by the lock arm 61 is maintained so that the paper cover 20 is not opened. Further, when a user depresses the open button 18, the intersection angle $\theta_{AB}$ is equal to 90°, and hence the inclined surface 63*d* can slide on the peripheral surface of the bearing 54 without being caught thereon. Therefore, the locking of the bearing 54 by the lock arm 61 can be smoothly cancelled.

Referring back to FIG. 9, in a case in which the intersection angle $\theta_{AB}$ is larger than 90°, the center axis of the hinge portion 32*a* matches with a position denoted by the reference symbol R2, and the pivoting-direction tangential line of the center axis P of the platen roller 51 matches with a line denoted by the reference symbol A2. However, the inclined surface 63*d* is brought into abutment against the peripheral surface of the bearing 54 at the same contact point Pa. On this occasion, the contact point Pa is farther from the center axis R2 than the pivoting-direction tangential line A2. This point is contrary to that in the former case in which the intersection angle $\theta_{AB}$ is smaller than 90°. In the case of such a relative positional relationship, when the external force is applied to the thermal printer 1, the locking of the bearing 54 by the lock arm 61 is maintained so that the paper cover 20 is not opened. However, in a case in which the intersection angle $\theta_{AB}$ is larger than 110°, a point Pb at the distal end position of the inclined surface 63*d* is excessively closer to the center axis Q than the contact point Pa. Therefore, even when a user depresses the open button 18, the inclined surface 63*d* is caught on the bearing 54 at the point Pb, and thus cannot climb over the bearing 54. Therefore, the locking of the bearing 54 by the lock arm 61 cannot be cancelled. For the above-mentioned reason, it is required that the intersection angle $\theta_{AB}$ be equal to or larger than 90° and equal to or smaller than 110°. It is more preferred that an upper limit value of the intersection angle $\theta_{AB}$ be 100° in consideration of manufacturing tolerance. In this case, the intersection angle $\theta_{AB}$ falls within a range of from 90° to 100°. Moreover, within this range, it is most preferred that a relation of the intersection angle $\theta_{AB}$=90° be satisfied.

Figure 10:
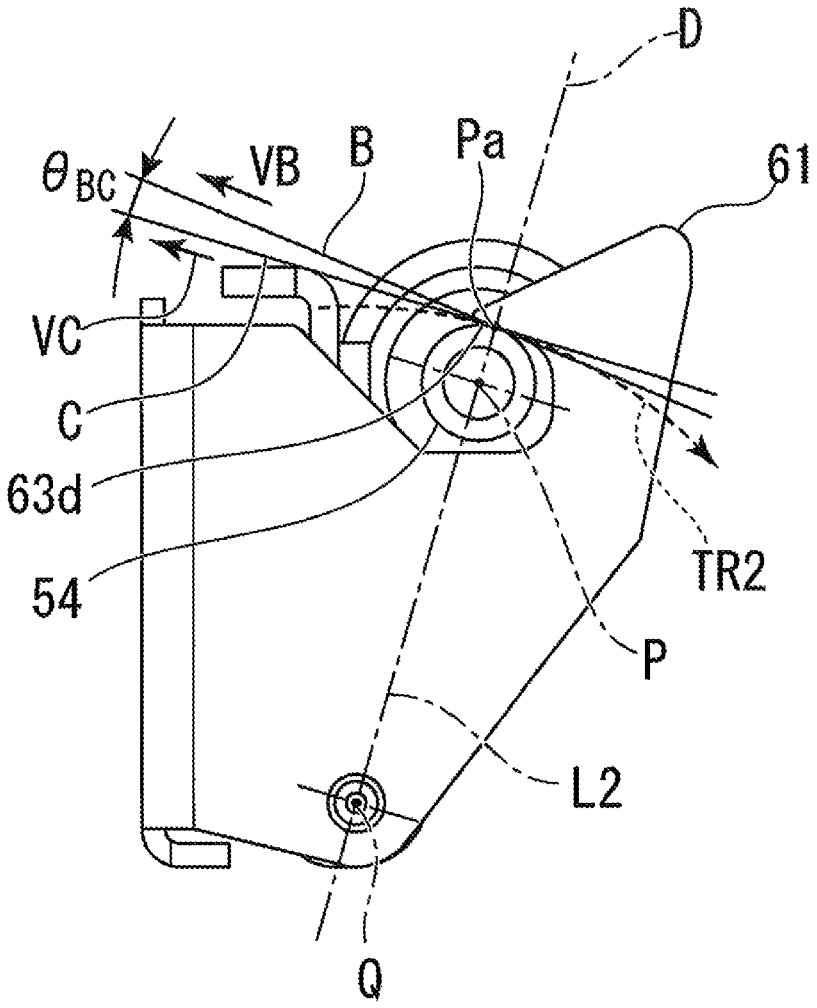
FIG. 10 is a view for illustrating a state in which the bearing of the platen roller is inserted into the roller insertion groove and locked by the lock arm, and illustrating a desirable relative positional relationship between the straight line B extending along the platen roller engagement portion of the lock arm and a pivoting-direction tangential line C at a contact point Pa between the platen roller engagement portion and the platen roller.

As illustrated in FIG. 10, the inclined surface 63*d* (platen roller engagement portion) and the platen roller 51 not only move relatively about the center axis R (R1, R2) of the platen roller 51 as described above, but also move relatively about the center axis Q of the inclined surface 63*d*. Therefore, it is required that not only the above-mentioned intersection angle $\theta_{AB}$ but also an intersection angle $\theta_{BC}$ be specified. FIG. 10 is a view for illustrating a state in which the bearing 54 is inserted into the roller insertion groove 35 (not shown) and locked by the lock arm 61, and illustrating a desirable relative positional relationship between the straight line B extending along the inclined surface 63*d* of the lock arm 61 and a pivoting-direction tangential line C at the contact point Pa between the inclined surface 63*d* and the platen roller 51. The broken line denoted by the reference symbol TR2 in FIG. 10 shows a track of the contact point Pa on the inclined surface 63*d* pivoting about the center axis Q.

As illustrated in FIG. 10, when viewed in the right-and-left direction extending along the center axis P, the intersection angle $\theta_{BC}$ in the closing direction of the lock arm 61 satisfies a relation of $0° \leq \theta_{BC} \leq 10°$. The intersection angle $\theta_{BC}$ is formed between the straight line B extending along the inclined surface 63*d* and the tangential line C of the track TR2 obtained when the contact point Pa between the bearing 54 held in the roller insertion groove 35 and the inclined surface 63*d* (platen roller engagement portion) pivots in the unlocking direction of the lock arm 61.

In this case, the tangential line C corresponds to a straight line orthogonal at a position of the contact point Pa to a straight line L2 that passes the contact point Pa and the center axis Q when the upper surface of the bearing 54 inserted into the roller insertion groove 35 is held down by the inclined surface 63*d* of the lock arm 61. The above-mentioned intersection angle $\theta_{BC}$ in the closing direction of the lock arm 61 refers to an angle formed between a vector VC having a direction of separating away from the center axis R along the tangential line C, and the vector VB having the direction of separating away from the center axis R along the straight line B.

Figure 11:
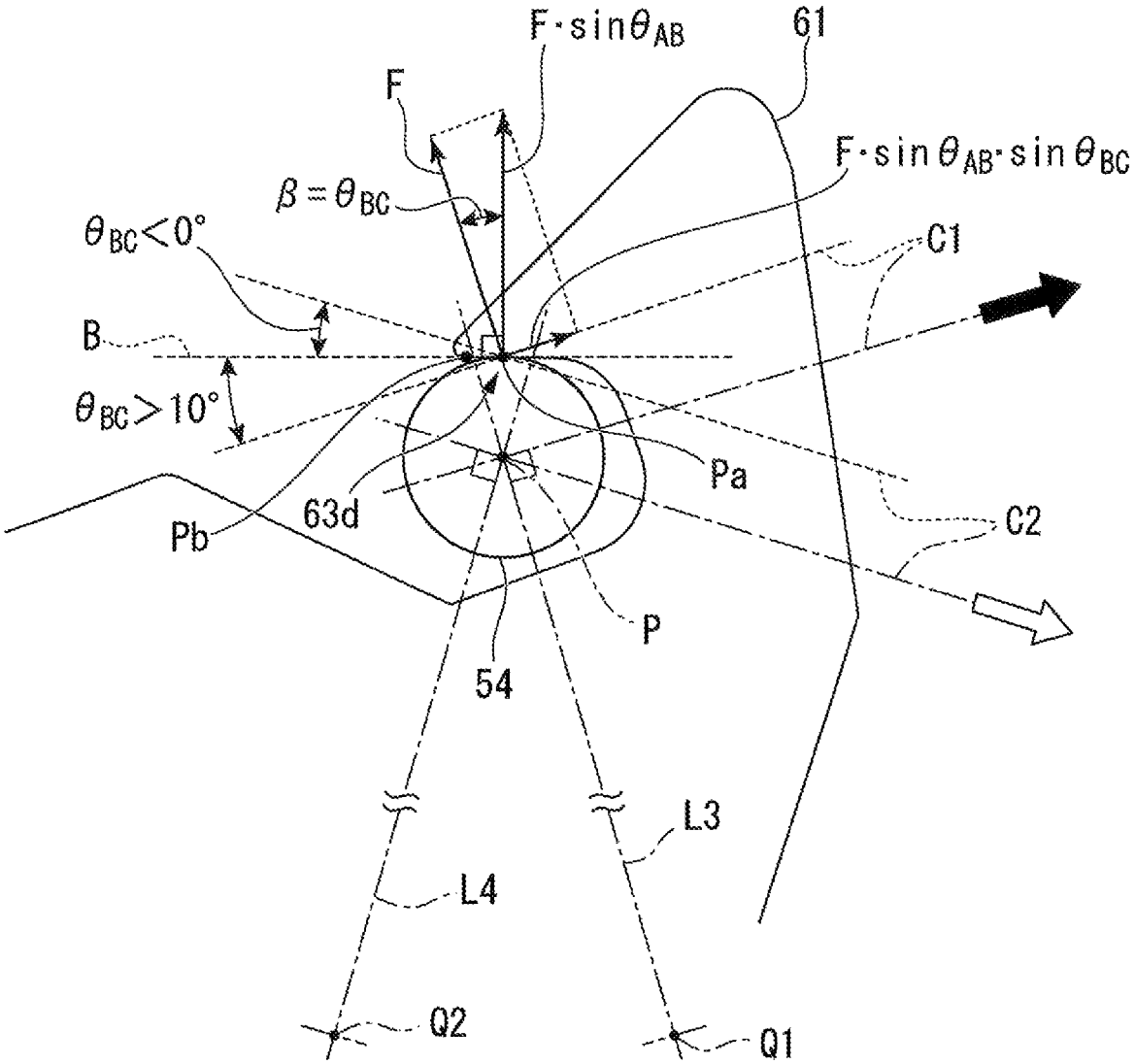
FIG. 11 is a partial enlarged view for illustrating an undesirable relative positional relationship between the straight line B extending along the platen roller engagement portion of the lock arm and pivoting-direction tangential lines C1 and C2 at the contact point Pa between the platen roller engagement portion and the bearing of the platen roller.

The intersection angle $\theta_{BC}$ is now described with reference to FIG. 11. FIG. 11 is a partial enlarged view for illustrating a state in which the bearing 54 of the platen roller 51 is inserted into the roller insertion groove 35 (not shown) and locked by the lock arm 61, and illustrating an undesirable relative positional relationship between the straight line B extending along the inclined surface 63*a* of the lock arm 61 and pivoting-direction tangential lines C1 and C2 of the center axis P of the platen roller 51. As the pivoting-direction tangential line C1, a straight line that passes the position of the contact point Pa and is parallel to the pivoting-direction tangential line C1 is indicated by the broken line. Accordingly, an intersection angle formed between the pivoting-direction tangential line C1 and the straight line B is equal to the intersection angle $\theta_{BC}$ formed between the pivoting-direction tangential line C1 indicated by the broken line and the straight line B, and represents a case of $\theta_{BC}$>10°. Meanwhile, as the pivoting-direction tangential line C2, a straight line that passes the position of the contact point Pa and is parallel to the pivoting-direction tangential line C2 is indicated by the broken line. Accordingly, an intersection angle formed between the pivoting-direction tangential line C2 and the straight line B corresponds to the intersection angle $\theta_{BC}$ formed between the pivoting-direction tangential line C2 indicated by the broken line and the straight line B, and is a negative angle, that is, satisfies a relation of $\theta_{BC}$<0°.

First, in a case in which the intersection angle $\theta_{BC}$ is the negative angle smaller than 0°, the center axis Q matches with a position denoted by the reference symbol Q2, and a straight line passing the center axis Q2 and the center axis P matches with a line denoted by the reference symbol L4. Further, a pivoting-direction tangential line matches with a line denoted by the reference symbol C2. Moreover, the point Pb at the distal end position of the inclined surface 63*d* is located on a locking direction side of the lock arm 61 with respect to the straight line L4 and the contact point Pa. In this case, for the same reason as that described for the case in which the intersection angle $\theta_{AB}$>110° in FIG. 9, the point Pb at the distal end position of the inclined surface 63*d* is excessively closer to the center axis Q2 than the contact point Pa. Therefore, even when a user depresses the open button 18, the inclined surface 63*d* is caught on the bearing 54 at the point Pb at the distal end position, and thus cannot climb over the bearing 54. Therefore, the locking of the bearing 54 by the lock arm 61 cannot be cancelled.

Further, in a case in which the intersection angle $\theta_{BC}$ exceeds 0°, the center axis Q matches with a position denoted by the reference symbol Q1, and a straight line passing the center axis Q1 and the center axis P matches with a line denoted by the reference symbol L3. Further, a pivoting-direction tangential line matches with a line denoted by the reference symbol C1. Moreover, the point Pb at the distal end position of the inclined surface 63*d* is located on the locking direction side of the lock arm 61 with respect to the straight line L3. Meanwhile, the contact point Pa is located on the unlocking direction side of the lock arm 61 with respect to the straight line L3. The position of the contact point Pa on the inclined surface 63*d* is the same as that in the case in which the intersection angle $\theta_{BC}$ is the negative angle smaller than 0°. Further, the angle β illustrated in FIG. 11 is equal to the intersection angle $\theta_{BC}$. For example, when the external force received by the casing 3 causes the force F in the direction of disengaging the bearing 54 from the roller insertion groove 35, as illustrated in FIG. 9, the force component $F \cdot \sin \theta_{AB}$ is applied to the inclined surface 63*d* in the vertical direction. At the contact point Pa on the inclined surface 63*d*, the force component $F \cdot \sin \theta_{AB}$ generates a force component $F \cdot \sin \theta_{AB} \cdot \sin \theta_{BC}$ of pivoting the lock arm 61 about the center axis Q1 in an opening direction. Even when the frictional force between the bearing 54 and the inclined surface 63*d* is increased by intensifying the elastic members 46 configured to bias the lock arm 61 in the closing direction, the lock arm 61 is liable to pivot, and hence it is difficult to reliably maintain the locked state against the force component $F \cdot \sin \theta_{AB} \cdot \sin \theta_{BC}$. Therefore, in a case in which the intersection angle $\theta_{BC}$ is larger than 10°, when the external force is applied to the thermal printer 1, there is a fear in that the locking of the bearing 54 by the lock arm 61 is cancelled so that the paper cover 20 is opened.

Meanwhile, in a case in which the intersection angle $\theta_{BC}$=0°, specifically, the tangential line C and the straight line B are parallel to each other, a relation of $\sin \theta_{BC}$=0 is satisfied. Therefore, the force component $F \cdot \sin \theta_{AB} \cdot \sin \theta_{BC}$ in the direction of causing the lock arm 61 to pivot becomes zero. Accordingly, even when there is no pressurization by the elastic members 46 at the time of application of the external force to the thermal printer 1, the locking of the bearing 54 by the lock arm 61 is maintained so that the paper cover 20 is not opened. Further, when a user depresses the open button 18, the tangential line C and the straight line B are parallel to each other, and hence the inclined surface 63*d* can slide on the peripheral surface of the bearing 54 without being caught thereon. Therefore, the locking of the bearing 54 by the lock arm 61 can be smoothly cancelled. For the above-mentioned reason, it is required that the intersection angle $\theta_{BC}$ be equal to or larger than 0° and equal to or smaller than 10°. It is more preferred that an upper limit value of the intersection angle $\theta_{BC}$ be 5° in consideration of manufacturing tolerance. In this case, the intersection angle $\theta_{BC}$ falls within a range of from 0° to 5°. Moreover, within this range, it is most preferred that a relation of the intersection angle $\theta_{BC}=0°$ be satisfied.

The main points of the above-mentioned embodiment of the present invention are summarized below. The thermal printer module 30 according to the embodiment of the present invention includes: the casing 3 including the sheet receiving portion 32; the paper cover 20, which is mounted to the casing 3 so as to be pivotable, and is configured to open and close the sheet receiving portion 32; the platen roller 51 provided to the paper cover 20 so as to be freely rotatable; the main body frame 31, which is provided in the casing 3, and has the roller insertion groove 35 configured to receive the bearing 54 of the platen roller 51 to be inserted into the roller insertion groove 35 when the paper cover 20 is closed; the lock arm 61, which is provided to the main body frame 31 so as to be pivotable, and is configured to hold down, by the inclined surface 63*d*, the bearing 54 of the platen roller 51 inserted into the roller insertion groove 35; the elastic member 46 configured to apply a biasing force to the lock arm 61 in a direction of causing the lock arm 61 to pivot so as to maintain holding of the bearing 54 by the inclined surface 63*d*; and the thermal head 41 provided at a position opposed to the platen roller 51 having the bearing 54 held in the roller insertion groove 35. When viewed in the direction extending along the center axis P of the bearing 54, the inclined surface 63*d* and the tangential line A of the track TR1 obtained when the axis P of the bearing 54 held in the roller insertion groove 35 moves along with the opening operation of the paper cover 20 form the intersection angle $\theta_{AB}$ in the closing direction of the lock arm 61, and the intersection angle $\theta_{AB}$ satisfies the relation of $90° \leq \theta_{AB} \leq 110°$. In addition, when viewed in the direction extending along the center axis P of the bearing 54, the inclined surface 63*d* and the tangential line C of the track TR2 obtained when the contact point Pa between the bearing 54 held in the roller insertion groove 35 and the inclined surface 63*d* pivots in the unlocking direction of the lock arm 61 form the intersection angle $\theta_{BC}$ in the closing direction of the lock arm 61, and the intersection angle $\theta_{BC}$ satisfies the relation of $0° \leq \theta_{BC} \leq 10°$. According to the thermal printer module 30, through satisfaction of both of two conditions relating to the intersection angle $\theta_{AB}$ and the intersection angle $\theta_{BC}$, even when the external force is applied to the paper cover 20 in a direction of opening the paper cover 20, the platen roller 51 can be more stably held by the lock arm 61.

Moreover, in the thermal printer module 30 described above, when viewed in the direction extending along the center axis P of the bearing 54, it is preferred that the inclined surface 63*d* and the tangential line C of the track TR2 obtained when the contact point Pa between the bearing 54 held in the roller insertion groove 35 and the inclined surface 63*d* pivots in the unlocking direction of the lock arm 61 be parallel to each other. In this case, at the inclined surface 63*d*, the platen roller 51 does not generate a force component in a direction of causing the lock arm 61 to pivot in the unlocking direction. Thus, the platen roller 51 is more reliably held by the lock arm 61.

In addition, in the thermal printer module 30 described above, when viewed in the direction extending along the center axis P of the bearing 54, the inclined surface 63*d* and the tangential line A of the track TR1 obtained when the center axis P of the bearing 54 held in the roller insertion groove 35 moves along with the opening operation of the paper cover 20 may be orthogonal to each other. In this case, when the external force is applied to the platen roller 51 in the direction of opening the paper cover 20, the force in the direction of disengaging the platen roller 51 from the roller insertion groove 35 does not include the force component exerted by the platen roller 51 on the inclined surface 63*d* to push away the lock arm 61 in the unlocking direction. Accordingly, the platen roller 51 is further reliably held by the lock arm 61.

The thermal printer 1 according to the embodiment of the present invention includes the thermal printer module 30 having the above-mentioned configuration. The thermal printer 1 stably holds the platen roller 51, and is resistant to the external force such as drop impact.

The present invention is not limited to the above-mentioned embodiment, and various modification examples may be employed within the technical scope of the present invention. For example, in the above-mentioned embodiment, the lever 90 is used for the operation of disengaging the platen roller 51, but the present invention is not limited to this configuration. Other link mechanisms and cam mechanisms may be used instead. Further, in the above-mentioned embodiment, a cushioning member may be arranged around the casing 3 or between the main body frame 31 and the casing 3. With this configuration, an influence such as drop impact can be further reduced. Further, the thermal printer module 30 may be formed integrally with the casing 3. Alternatively, the thermal printer module 30 may be formed separately from the casing 3, and fixed in the casing 3. In a case of adopting the thermal printer module 30 formed integrally with the casing 3, there is an advantage in that the number of components and manufacturing cost can be reduced.

Besides the above, the components in the above-mentioned embodiments may be replaced by well-known components as appropriate without departing from the gist of the present invention.

What is claimed is:

1. A thermal printer module, comprising:

a housing including a roll sheet receiving portion;

a cover, which is mounted to the housing so as to be pivotable, and is configured to open and close the roll sheet receiving portion;

a platen roller provided to the cover so as to be freely rotatable;

a support frame, which is provided in the housing, and has a groove configured to receive a shaft of the platen roller to be inserted into the groove when the cover is closed;

a lock arm, which is provided to the support frame so as to be pivotable, and is configured to hold down, by a platen roller engagement portion, the shaft of the platen roller inserted into the groove, wherein the platen roller engagement portion comprises a substantially linear surface portion that contacts the shaft held in the groove;

a biasing member configured to apply a biasing force to the lock arm in a direction of causing the lock arm to pivot so as to maintain holding of the shaft by the platen roller engagement portion; and a printing head provided at a position opposed to the platen roller having the shaft held in the groove, wherein, when viewed in a direction extending along an axis of the shaft, the substantially linear surface portion of the platen roller engagement portion and a tangential line of a track obtained when the axis of the shaft held in the groove moves along with an opening operation of the cover form an intersection angle $\theta_{AB}$ in a closing direction of the lock arm, and the intersection angle $\theta_{AB}$ satisfies a relation of $90° \leq \theta_{AB} \leq 110°$, and wherein, when viewed in the direction extending along the axis of the shaft, the substantially linear surface portion of the platen roller engagement portion and a tangential line of a track obtained when a contact point between the shaft held in the groove and the substantially linear surface portion of the platen roller engagement portion pivots in an unlocking direction of the lock arm form an intersection angle $\theta_{BC}$ in the closing direction of the lock arm, and the intersection angle $\theta_{BC}$ satisfies a relation of $0° \leq \theta_{BC} \leq 10°$.

2. The thermal printer module according to claim 1, wherein, when viewed in the direction extending along the axis of the shaft, the platen roller engagement portion and the tangential line of the track obtained when the contact point between the shaft held in the groove and the platen roller engagement portion pivots in the unlocking direction of the lock arm are parallel to each other.

3. The thermal printer module according to claim 2, wherein, when viewed in the direction extending along the axis of the shaft, the platen roller engagement portion and the tangential line of the track obtained when the axis of the shaft held in the groove moves along with the opening operation of the cover are orthogonal to each other.

4. The thermal printer module according to claim 1, wherein, when viewed in the direction extending along the axis of the shaft, the platen roller engagement portion and the tangential line of the track obtained when the axis of the shaft held in the groove moves along with the opening operation of the cover are orthogonal to each other.

* * * * *